United States Patent [19]

Hoeboer

[11] 4,244,767

[45] Jan. 13, 1981

[54] LINEAR TAIL SEALER

[75] Inventor: Cornelis H. W. Hoeboer, Hilvarenbeek, Netherlands

[73] Assignee: Mapatent N.V., Curacao, Netherlands

[21] Appl. No.: 31,453

[22] Filed: Apr. 19, 1979

Related U.S. Application Data

[63] Continuation-in-part of Ser. No. 873,255, Jan. 31, 1978, abandoned.

[30] Foreign Application Priority Data

Jan. 31, 1977 [NL] Netherlands ..... 7700966

[51] Int. Cl.[3] ..... G05G 15/00

[52] U.S. Cl. ..... 156/351; 104/147 R; 104/155; 104/244; 156/357

[58] Field of Search ..... 156/443, 446, 356, 357, 156/351, 352, 184, 187; 242/56 R; 104/155, 147 R, 154, 244, 246; 118/672, 674

[56] References Cited

U.S. PATENT DOCUMENTS

| | | | |
|---|---|---|---|
| 3,014,459 | 12/1961 | Gustairs | 104/155 X |
| 3,044,532 | 7/1962 | Ghisoni | 156/361 |
| 3,045,611 | 7/1962 | Murray | 104/155 |
| 3,162,560 | 12/1964 | Henson et al. | 156/361 |
| 3,318,262 | 5/1967 | Ganzinotti | 104/155 |
| 3,393,105 | 7/1968 | Tellier | 156/446 X |
| 3,521,551 | 7/1970 | Boxmeyer | 118/672 |
| 3,534,690 | 10/1970 | Lockand | 104/155 |
| 3,553,055 | 1/1971 | Janik | 156/429 X |
| 3,875,868 | 4/1975 | Martin | 104/173 X |

*Primary Examiner*—David A. Simmons

*Attorney, Agent, or Firm*—Michael, Best & Friedrich

[57] ABSTRACT

A machine which is operative for handling a roll of wound sheet-like material having a loose tail end includes rollers which rotate the roll in the rewinding direction, blowers which unwind the loose tail end off the roll during rotation, and a delivery table upon which the unwound loose tail end settles for the application of glue. A first sensor detects the unwinding of the tail end off the roll and activates a normally deactivated second sensor which turns off the rollers when the tail end reaches a predetermined location on the delivery table. Adhesive is next applied to the stationary tail end by a glue gun which is movably mounted on a pneumatically controlled carriage assembly. The glued tail end is thereafter rewound upon the roll, and the roll is subsequently ejected from the machine. A third sensor detects the initial presence of the roll upon the rollers and will initiate ejection of the roll after a predetermined time period elapses, regardless of operation of the glue gun.

33 Claims, 11 Drawing Figures

LINEAR TAIL SEALER

RELATED APPLICATIONS

This application is a continuation-in-part of a copending application Ser. No. 873,255 filed Jan. 31, 1978 entitled "DEVICE FOR ADHERING THE END OF WOUND SHEET-LIKE MATERIAL TO THE ROLL" for which a claim for priority under 35 U.S.C. 119 has been acknowledged.

BACKGROUND OF THE INVENTION

I. Field of the Invention

The invention generally relates to roll product finishing machines and, more particularly, to machines which handle a roll of sheet-like material having a loose tail end so that the loose tail end may be glued upon the body of the roll.

II. Description of the Prior Art

In roll product finishing operations, such as those used by the paper converting industry, cants of wound sheet-like material are formd from a large parent supply roll on winding machines and proceed, typically in assembly-line fashion, to machines which glue the loose tail ends upon the cants and which then eject the cants toward wrapping machines.

One problem caused by such an operation is that glue might not be consistently applied upon the loose tail end at a proper distance from the terminal edge the tail. Thus, excess paper might project outwardly from the glue seam and interfere with the operation of the wrapping machines. Also, the presence of excess paper forms an unattractive commercial product.

An associated problem arises when the cant is delivered to the machine having a loose tail end which is partially stuck to the body of the roll, or torn and uneven, or otherwise defective. Such a cant is not in condition for gluing and should be ejected from the machine without the application of adhesive.

Yet another problem is occasioned by the high speed, assembly-line nature of the operation itself, which demands that the glueing operation be performed as quickly as possible and that the cant being glued is ejected in advance of the next cant's arrival. This avoids jamming and the resultant loss of production time.

Attention is directed to the following U.S. Patents which are specifically concerned with roll finishing apparatus:

| | | |
|---|---|---|
| Ghisoni | 3,044,532 | July 17, 1962 |
| Henson, et al | 3,162,560 | December 22, 1964 |
| Tellier | 3,393,105 | July 16, 1968 |
| Janik | 3,553,055 | January 5, 1971 |

Of the four cited patents, Tellier directly addresses the problem of excess paper projecting beyond the glue seam (col. 1, lines 49 through 72), which he describes as "universal in the paper industry". Tellier thereafter describes the use of a single, continuously actuated photocell unit 162,164 to sense the location of the tail end and thereafter energize the cam-actuated gluing tines 89 and 90 to displace the tail end against the adhesive application rollers 124. A principal feature of Tellier's device is that, during the entire gluing cycle, the cant is being continuously rotated on the drive rollers 27 and 28.

While Hensen does not directly address the problem of excess paper, the reference describes the use of a single, continuously actuated photocell unit 29*a*, 29*b*, to stop rotation of the drive rollers 10,11 when the tail end has arrived at a predetermined location for gluing. Henson also discloses the use of a pair of glue guns 30 located on reciprocative trolley carriage members 50 and 70 which are movably mounted on trolley lead screws 51 and 71.

Neither Ghisoni nor Janik are concerned with the excess paper problem, and use single, continuously actuated photosensors 19 and 91, respectively, to stop rotation of the cant, and glue is thereafter deposited on the body of the cant itself. The position of the glue seam in Janik's device is adjustable, inasmuch as the entire glue carriage support frame 117 can be vertically shifted relative to the cant.

None of the above cited references, alone or in combination, teaches or suggests the use of two sensors, one of which is continuously actuated and the other of which is selectively actuated in response to a signal from the first, to insure that the glue seam is invariably properly placed on the tail. None teaches or suggests a means for detecting a cant which is not in condition for gluing. None teaches or suggests the use of a pneumatic, high speed reciprocating glue gun mechanism to substantially reduce the time it takes to glue the tail end. Finally, none teaches or suggests a means for insuring that the cant is ejected from the machine in a timely fashion and in advance of the arrival of another cant. In short, none of the references teaches or suggests a device which is applicable for use in a high production, assembly-line operation.

Attention is also directed to the following U.S. Patents which, while not disclosing roll finishing apparatus, may be considered relevant with regard to certain features of the invention:

| | | |
|---|---|---|
| Ganzinotti | 3,318,262 | May 9, 1967 |
| Boxmeyer | 3,521,551 | July 21, 1970 |
| Martin | 3,875,865 | April 8, 1975 |

Ganzinotti discloses a fluid propulsion device utilizing a pneumatic conduit 9 having a central core 10 and surrounded by a frame assembly 5, 6, 11, 12, so that excessive deformation and deterioration of the pneumatic conduit 9 is eliminated. Ganzinotti also discloses the use of prelocated "actuating zones" for driving, braking and stopping the carriage 37 on the rail 35. Ganzinotti does not teach or suggest a means for eliminating excessive deformation and deterioration of a pneumatic conduit without the attendant creation of friction which impedes rapid acceleration and movement of the carriage. Nor does Ganzinotti teach or suggest a strictly pneumatically controlled acceleration and deceleration system not dependent upon fixed, non-adjustable "actuating zones ".

Boxmeyer discloses the use of two sensors 17 and 19, both of which are continuously actuated and connected in series so that their respective outputs are 180° out of phase. Displacement of a roller member 97 moves core 95 and unbalances the combined output, heretofore balanced, thus creating a voltage output. Boxmeyer neither teaches nor suggests an arrangement whereby one continuously actuated sensor selectively activates another sensor.

Lastly, Martin discloses a trolley carriage which is operatively connected with a continuous cable for movement. Nothing in Martin teaches or suggests the use of the trolley carriage in a fluid propulsion device.

SUMMARY OF THE INVENTION

The invention provides a machine which is operative for handling a roll of wound, sheet-like material having a loose tail end. The machine includes means for rotating the roll in a direction tending to wind the loose tail end upon the roll, means for unwinding the loose tail end off the roll during rotation, and a delivery table upon which the unwound loose tail settles for the application of glue. In accordance with the invention, first sensor means is provided for detecting the passage of the loose tail end after it has been unwound off the roll but prior to its arrival on the delivery table, and second sensor means is provided which is operative between a normally deactivated condition and an activated condition for detecting the location of the tail end at a predetermined position on the delivery table. First circuit means places the second sensor means in the activated condition in response to the detection of the tail end by the first sensor means, and second circuit means terminates operation of the roll rotation means in response to the detection by the now activated second sensor means of the location of the tail end at the predetermined position on the delivery table.

In another embodiment, the invention provides first corner edge sensing means for detecting the location of one corner edge of the tail end at a predetermined position on the delivery table and second corner edge sensing means for detecting the location of the other corner edge of the tail end at a predetermined position on the delivery table. Circuit means interconnects the first and second corner edge sensing means with the roll rotation means such that the operation of the roll rotation means is terminated when the corner edges of the tail end simultaneously arrive at their respective predetermined positions on the delivery table. Thus, should the tail end be uneven, the corner edges of the tail end will not simultaneously arrive at their respective predetermined positions, and a cant with such a defective tail end will not terminate operation of the roll rotation means.

The invention also provides a machine which has, in addition to the heretofore described roll rotation means, tail unwinding means, and delivery table, gluing means for applying glue to the loose tail end which is situated on the delivery table, as well as means for ejecting the roll off the roll rotation means. In this embodiment, primary ejection circuit means triggers operation of the roll ejection means subsequent to the operation of the gluing means. Roll sensor means is provided to detect the presence of the roll on the roll rotation means, and secondary ejection circuit means is included to operate the roll ejection means independently of the primary ejection circuit means at a predetermined time after the roll sensor means detects the initial presence of the roll on the roll rotation means. Timely ejection of the roll prior to the arrival of another roll is thus achieved.

In the preferred embodiment, the gluing means includes a fluid propulsion device comprising tube means having opposite ends and operative for conducting a pressurized fluid, supply conduit means for conducting a pressurized fluid from a source to each of the opposite ends, and vent means selectively operative for venting each of the opposite ends with the atmosphere. The glue gun is mounted on carriage means which is operatively connected with the tube means for movement between the opposite ends in response to the conduction of pressurized fluid by the tube means. Acceleration control means communicates with the supply conduit means and with the vent means for conducting pressurized fluid through the supply conduit means to a selected one of opposite ends and for venting the end opposite to the selected end through the vent means. By virtue of this agreement, accelerated movement is imparted to the carriage means from the selected end toward the opposite end. Deceleration control means communicates with the vent means for restricting the venting of the opposite end, which rapidly decelerates the carriage means.

Other objects and advantages will be pointed out in, or be apparent from, the specification and claims, as will obvious modifications of the embodiments shown in the drawings.

DESCRIPTION OF THE PREFERRED EMBODIMENT

Figure 1:
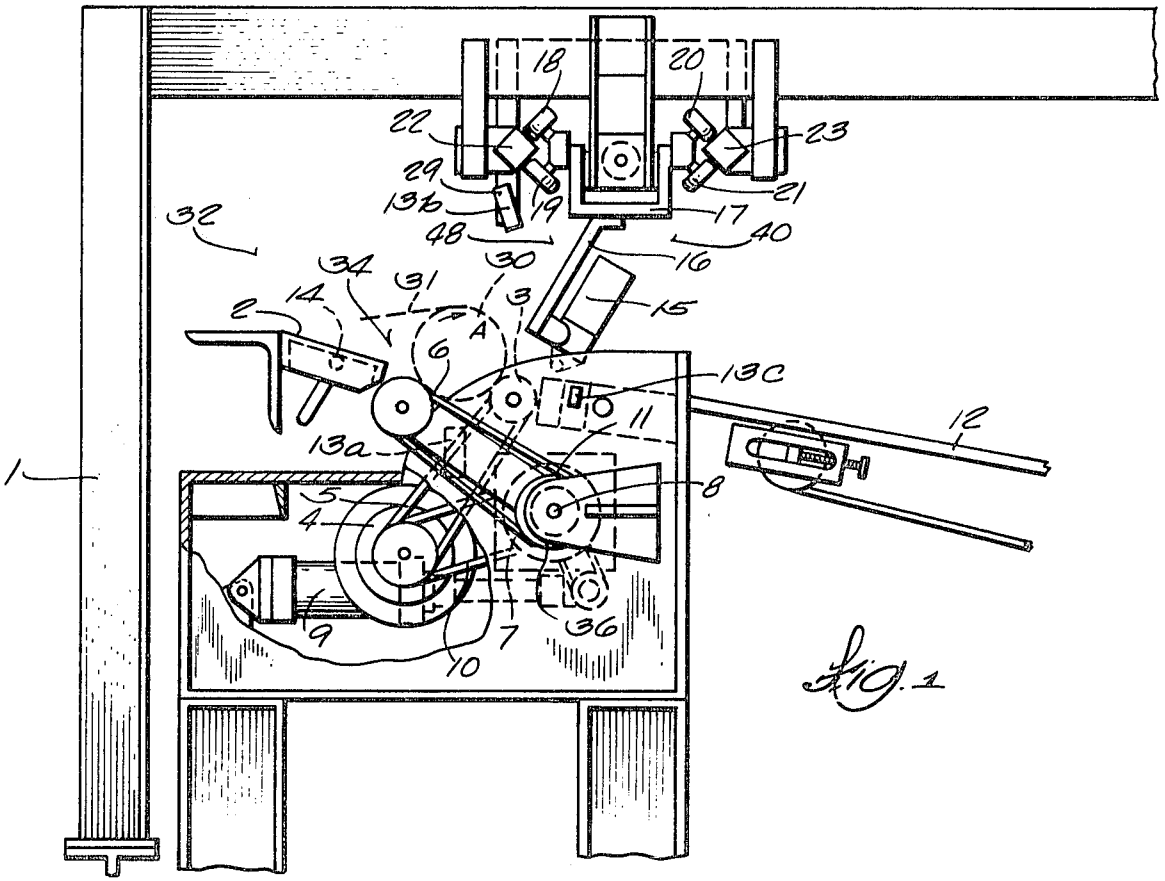
FIG. 1 is a side elevation view, partially broken away, showing a machine which is operative for handling a roll of wound sheet-like material having a loose tail end and which embodies the features of the invention.

A device 32 is shown in FIG. 1 which is operative to receive a roll 30 of wound sheet-like material having a loose tail end 31 and sequentially glue the loose tail end 31 upon the body of the roll 30 and then eject the roll 30. While the device 32 is broadly applicable for use with rolled cloth, plastic and metal products, the device 32 finds wide application in connection with the finishing of rolled paper products, such as cants of toilet tissue, and will hereafter be discussed in that environment.

Structurally, the device 32 includes a support frame 1 having a feed table 2 and a delivery table 12. Roller means 34 is mounted on the support frame 1 between the feed table 2 and delivery table 12 for rotating the paper product roll 30 or cant about its longitudinal axis in a direction tending to wind the loose tail end 31 onto the cant 30.

While various constructions are possible, in the illustrated embodiment (see FIG. 1), a first drive roller 3 is rotatably attached or journaled to the support frame 1. A roller drive motor 4 drives the first roller 3 by means of a suitable chain or belt transmission 5. A second drive roller 6 is located parallel to the first roller 3 intermediate the first roller 3 and the feed table 2. The second roller 6 is rotatably attached or journaled between a pair of support arms 7 which is attached to a shaft 8 which is itself rotatably journaled to the support frame 1. The second roller 6 is operatively connected with the motor 4 by a chain or belt transmission 10 which includes a chain sprocket 36 rotatable about the shaft 8 and an additional belt 11 extending between the shaft 8 and second roller 6. Operation of the motor 4 thus commonly drives the first roller 3 and the second roller 6 in a counterclockwise direction, and a cant 30 located on the rollers 3 and 6 is thereby rotated in the clockwise, or "rewinding", direction (as indicated by the arrow in FIG. 1).

Figure 10:
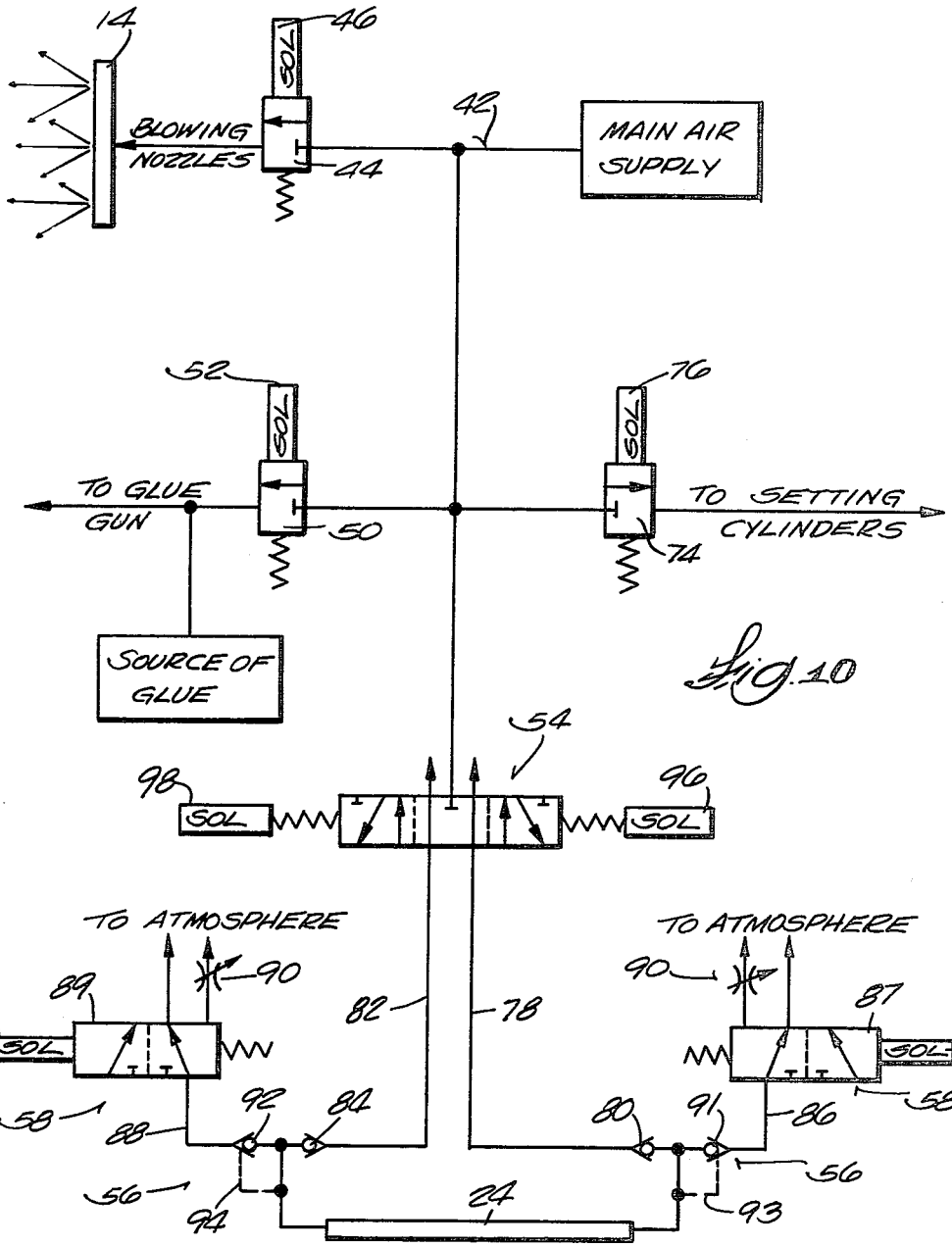
FIG. 10 is a schematic view of the pressurized air supply system associated with the control circuit shown in FIGS. 6 and 9.

Blower means 14 is provided for unwinding the loose tail end 31 off the cant 30 during rotation of the cant 30 on the rollers 3 and 6. As is shown in FIG. 1, one or more blowing nozzles 14 are spaced longitudinally along the feed table 2. Referring now to FIG. 10, pressurized air is delivered to the blowing nozzles 14 from an external source (as is shown diagrammatically in FIG. 10) through an air supply conduit 42 and a normally closed air valve 44. The air valve 44 is movable to an open position by means of a solenoid 46 or the like to direct pressurized air from the source to the blowing nozzles 14.

When pressurized air is directed out of the blowing nozzles 14 during rotation of the cant 30, the loose tail end 31 is lifted off the cant 30 by the pressurized air flow (as is shown in phantom lines in FIG. 1). The tail end 31 is consequently unwound off the body of the cant 30 and will eventually settle back upon the delivery table 12 (as shown in phantom lines in FIG. 8).

Figure 8:
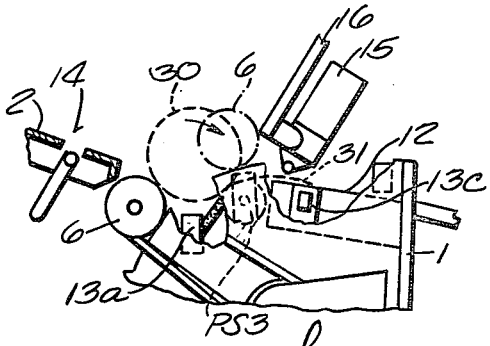
FIG. 8 is an enlarged and partially broken away side view of a portion of the machine shown in FIG. 1.

Continued rotation of the rollers 3 and 6 will cause the tail end 31 which is situated on the delivery table 12 to be rewound again upon the cant 30 (see FIG. 8). However, in order that a glue seam may be properly applied upon the tail end 31, rotation of the rollers 3 and 6 is stopped when the tail end 31 reaches a desired location on the delivery table 12, and gluing means 40 is provided for depositing glue upon the now stationary tail end 31. In the illustrated embodiment the gluing means 40 includes a glue gun 15 which is mounted on movable carriage means 48 for travel over the delivery table 12.

The glue gun 15 (see FIG. 10) communicates with the pressurized air supply conduit 42 through a normally closed air valve 50 which, like valve 44, is selectively movable to an open position by means of a solenoid 52 or the like. The glue gun 15 also communicates with an external source of glue (shown diagrammatically in FIG. 10) such that, when the valve 50 is in its open position, glue is pneumatically expelled from the gun 15 and applied upon the tail end 31. Depending upon the specific glue nozzles selected, the glue can be either sprayed or a glue seam extruded upon the tail end 31.

Figure 2:
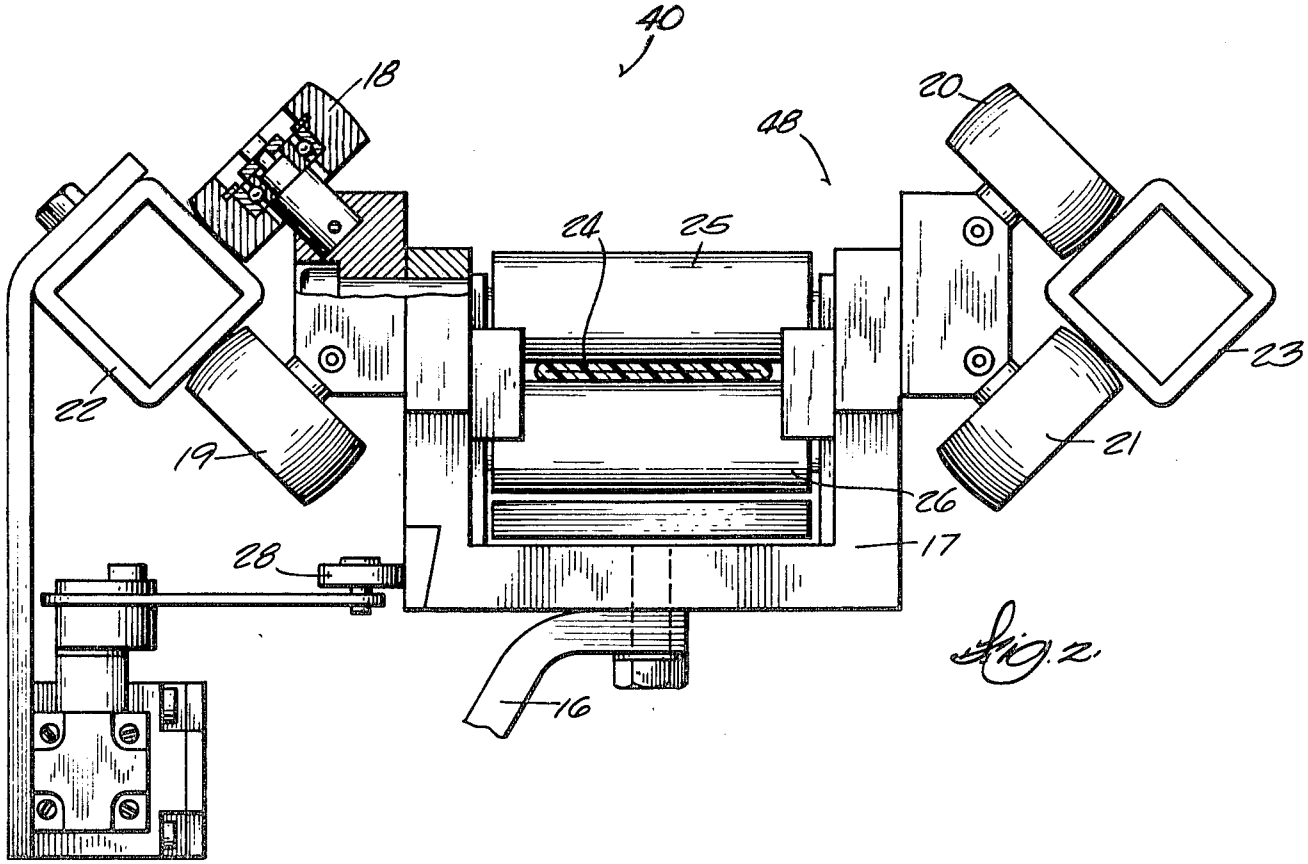
FIG. 2 is an enlarged view of one embodiment of a movable glue gun carriage which is incorporated in the machine shown in FIG. 1.

In the embodiment shown in FIGS. 1 and 2, the carriage means 48 includes a parallel pair of beams 22 and 23 which is attached to the support frame 1 above the delivery table 12 and which extends parallel to the rotational axes of the first and second drive rollers 3 and 6. A carriage chassis 17 is movably attached to the beams 22 and 23 by means of two sets of freely rotatable rollers or runners, respectively, 18, 19 and 20, 21. As can best be seen in FIG. 2, the rotational axes of each set of runners 18, 19 and 20, 21 are disposed at right angles to each other. By virtue of this construction, the carriage chassis 17 is fixed against vertical and transverse displacement relative to the longitudinal extension of the beams 22 and 23. However, the carriage chassis 17 can readily travel along the beams 22 and 23 back and forth over the delivery table 12, and thus back and forth over the tail end 31 positioned on the delivery table 12. As is seen in FIG. 1, the glue gun 15 is attached to the underbody of the carriage chassis 17 by means of a bracket 16.

Since high speed travel of the carriage chassis 17 is desirable, the carriage chassis 17 is pneumatically propelled along the beams 22 and 23. Generally, tube means 24 (see FIG. 2) is mounted on the frame 1 intermediate the beams 22 and 23. Each end of the tube means 24 (shown schematically in FIG. 10) communicates independently with the source of pressurized air through the air supply conduit 42 and normally closed inlet valve means 54, and vent means 56 likewise independently vents each end of the tube means 24 with the atmosphere through normally closed venting valve means 58. The flow of air into and out of either end of the tube means 24 can thus be controlled.

In the illustrated embodiment (see FIG. 2), the tube means 24 takes the form of an airtight hose made of resilient material, such as rubber, and the carriage chassis 17 includes a closely spaced pair of rollers 25 and 26 which pinch a portion of the hose 24, thereby blocking the passage of pressurized air through that portion. By virtue of this construction, when pressurized air is supplied through the inlet valve means 54 to one end of the airtight hose 24, the carriage chassis 17 will be accelerated away from that end by the expansion of the hose 24. At the same time, the rate at which the opposite or unpressurized end of the hose 24 is vented through the vent means 56 with the atmosphere is regulated. By suddenly restricting the venting of this end with the atmosphere, backpressure is created, and the accelerated movement of the carriage chassis 17 toward that end can be quickly impeded. Thus, the movement of the carriage chassis 17 rapidly back and forth upon the beams 22 and 23 is effectively controlled.

Figure 4:
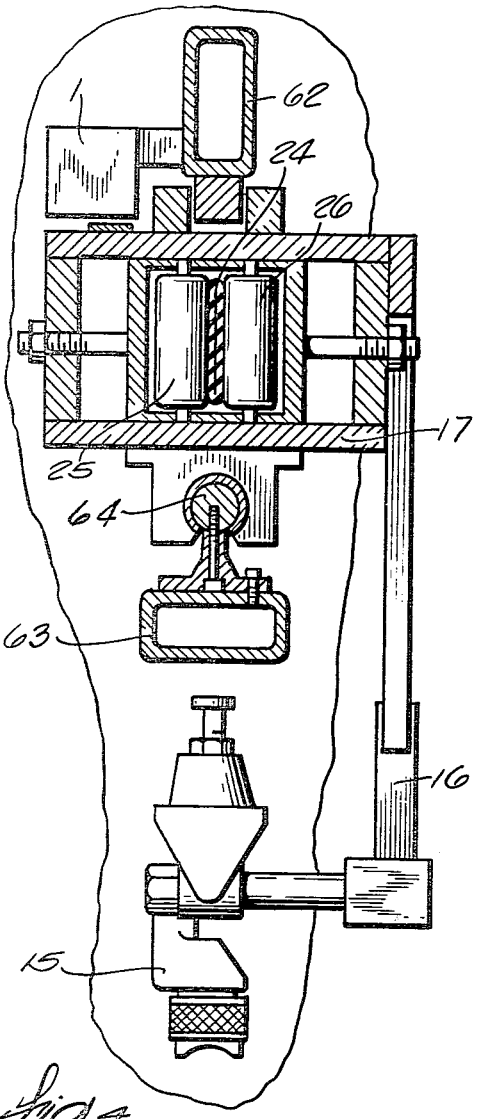
FIG. 4 is a sectional side view of the glue gun carriage taken generally along line 4—4 of FIG. 3.
Figure 3:
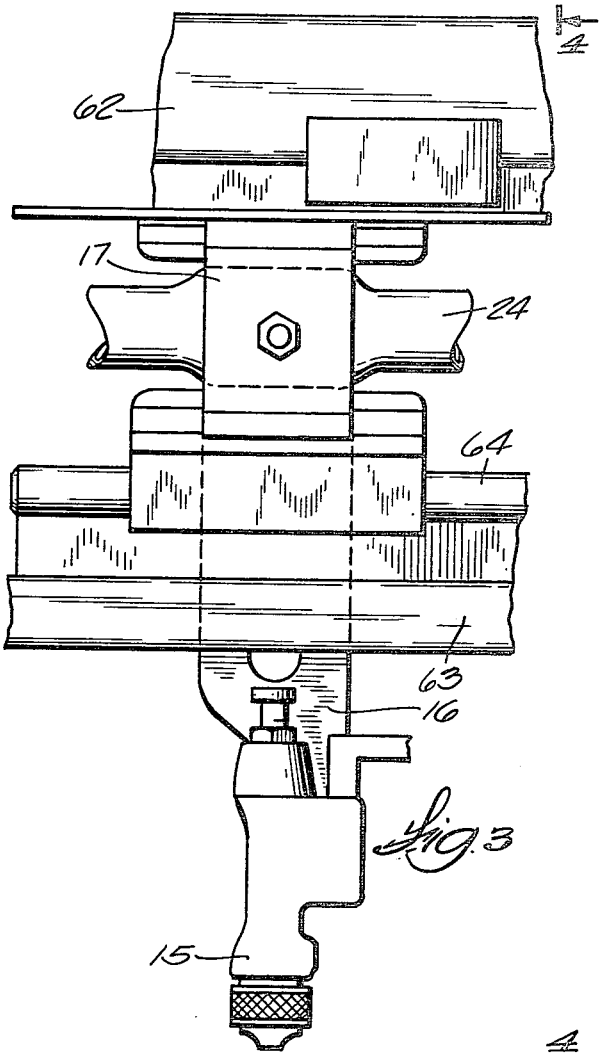
FIG. 3 is an enlarged front view of an alternative embodiment of a movable glue gun carriage suitable for use with the machine shown in FIG. 1.

An alternate structural embodiment of the carriage means 48 is shown in FIGS. 3 and 4. In this embodiment, instead of using horizontally spaced beams 22 and 23, the carriage chassis 17 is movably mounted between vertically spaced upper support beam 62 and lower support beam 63, which includes an integrally attached guide bar 64. The hose 24 passes intermediate the upper beam 62 and lower guide bar 64, and, like the embodiment shown in FIGS. 1 and 2, a pair of rollers 25 and 26 pinches the hose 24. Acceleration and deceleration of the carriage chassis 17 along the upper and lower support beams 62 and 63 is pneumatically controlled as heretofore described.

Figure 5:
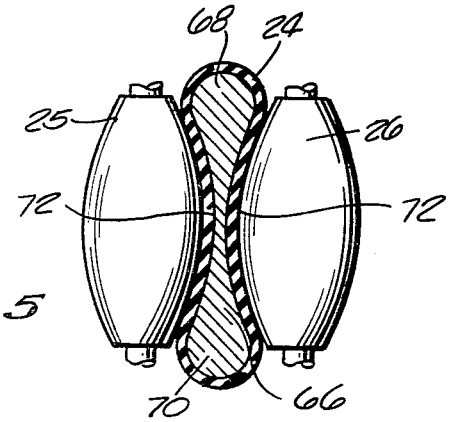
FIG. 5 is an enlarged side view of an alternative embodiment of the operative interface between the pneumatic hose and pinch rollers which may be incorporated in the glue gun carriage shown in either FIGS. 1 and 2 or FIGS. 3 and 4.

In either embodiment, a core member 66 (see FIG. 5) may be located within the entire longitudinal length of the hose 24. The core member 66 includes upper and lower ends 68 and 70 between which the hose 24 is resiliently stretched. The core member 66 also includes symmetrical, inwardly bowed, or concave, sidewalls 72. Correspondingly, the outer contours of the pinch rollers 25 and 26 are outwardly bowed, or convex, and mate with the inwardly bowed sidewalls 72 to form the airtight 37 pinch" in the hose 24. The core member 66 may be of solid construction, such as plastic or aluminum. Alternately, it may be resiliently constructed, such as a preformed sack filled with a compressible fluid or air. The core member 66 minimizes the extent to which the hose 24 is deformed or pinched by the rollers 25 and 26. Also, since the operative interface between the pinch rollers 25 and 26 and the hose 24 is confined to the middle portion of the hose 24, the outer ends 68 and 70 of the hose 24, which extend outwardly beyond the "pinched" area, are not deformed or pinched. Thus, a relatively frictionless operative interface between the pinch rollers 25 and 26 and the hose 24 is provided, and deterioration of the hose 24 occasioned by its being deformed between the pinch rollers 25 and 26, particularly at the ends 68 and 70 of the hose 24, is greatly minimized.

After a seam of glue has been applied upon the tail end 31, rotation is again imparted to the first and second drive rollers 3 and 6, thereby rewinding the now glued tail end 31 upon the cant 30, and means 9 is provided for ejecting the cant 30 from the device 32 after rewinding has occurred.

While various constructions of the ejecting means 9 are possible, in the illustrated embodiment (see FIG. 1), the support arms 7 upon which the second drive roller 6 is journaled are operatively connected to one or more pneumatic setting cylinders 9. The setting cylinders 9 (see FIG. 10) communicate with the pressurized air supply conduit 42 through a normally closed valve 74 which, like the heretofore discussed blow nozzle and glue gun valves, respectively, 44 and 50, is movable to an open position by means of a solenoid 76 or the like.

When the valve 74 is moved to its open position, the setting cylinders 9 are actuated and the support arms 7 are thereby rotated in a clockwise direction about the shaft 8 and out of the position shown in FIG. 1. As is apparent in FIG. 1, the second roller 6 will be pivoted relative to the first roller 3, and the cant 30 will be eventually pushed or ejected off both of the rollers 3 and 6 and onto the delivery table 12. Movement of the valve 74 back to its normally closed position returns the setting cylinder 9 and thus the second roller 6 back to the positions shown in FIG. 1.

OPERATION

The mechanical and pneumatic components of the device 32 as heretofore described are operated in response to an electrical control circuit (shown in FIGS. 6 and 7) through three general functional stages.

The first operational stage, hereafter referred to as the Tail Positioning Stage, begins as the cant 30 is delivered from a winding machine or the like (not shown) to the feed table 2 and rolls into position upon the first and second rollers 3 and 6. The cant 30 is rotated and the blow nozzles 14 direct pressurized air so as to lift the loose tail end 31 off the cant 30 to settle back upon the delivery table 12. When the tail end 31 is properly situated on the delivery table 12, power to the motor 4 is interrupted and rotation of the cant 30 terminates.

At this time, the second operational stage, hereafter referred to as the Tail Gluing Stage, commences, and the carriage-mounted glue gun 15 is pneumatically sent across the delivery table 12, applying glue upon the now stationary tail end 31.

The third operational stage, hereafter referred to as the Tail Rewinding and Cant Ejection Stage, closely follows, and rotation of the cant 30 recommences to wind the glued tail end 31 back upon the cant 30, after which the setting cylinders 9 are actuated to eject the cant 30 from the rollers 3 and 6.

A. The Tail Positioning Stage

Figure 6:
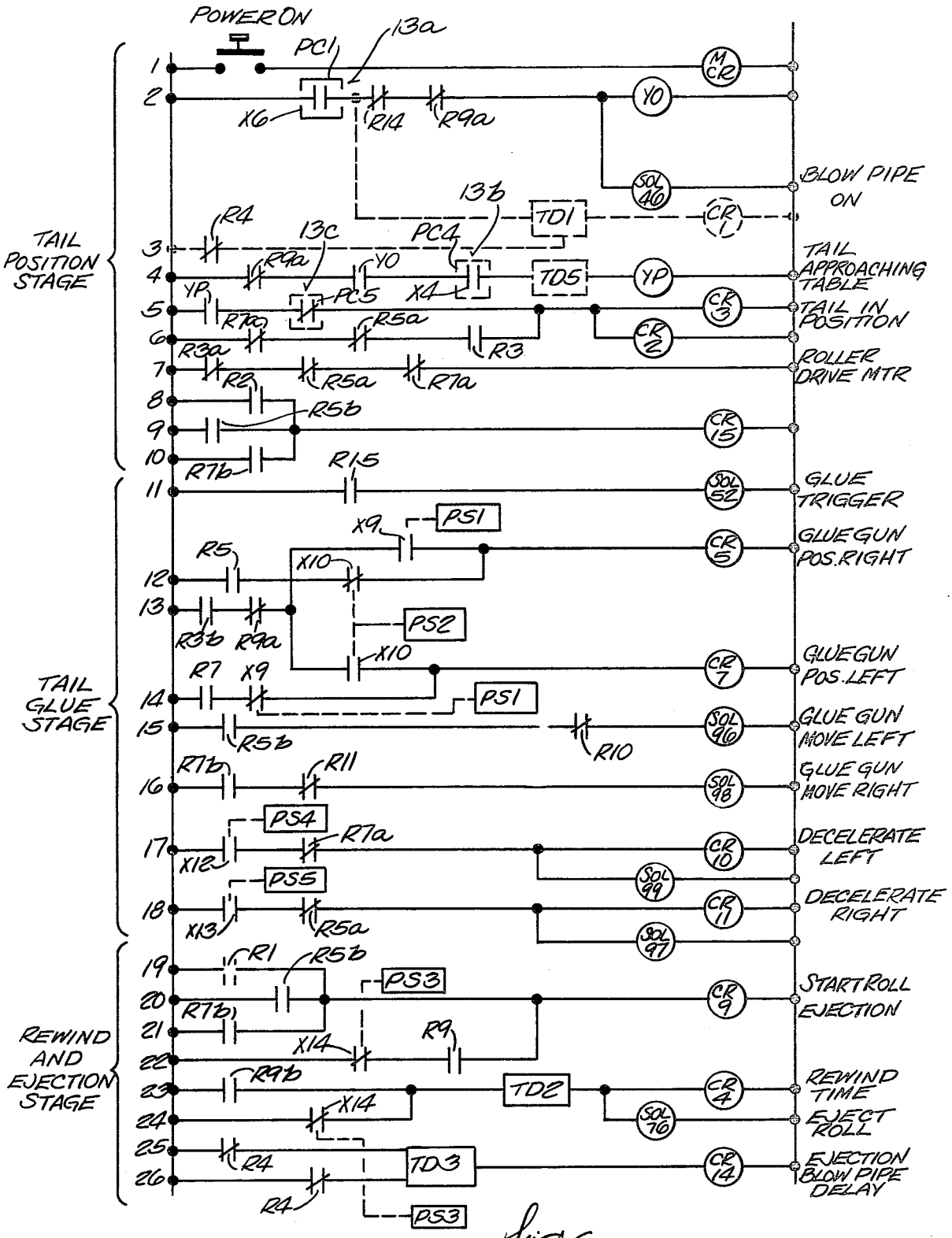
FIG. 6 is an electrical schematic diagram of a control circuit applicable for use with the machine shown in FIG. 1.

Reference is first made to lines 1 through 10 of FIG. 6 which illustrate one embodiment of the control circuit involved in properly positioning the loose tail end 31 upon the delivery table 12 prior to the application of glue.

When the power-on button is pushed, master control relay MCR is energized, and electrical power is supplied to the entire control circuit. In particular, power is supplied to the roller drive motor 4 (see line 7 of FIG. 6) through the series combination of three normally closed contacts R3*a*, R5*a*, and R7*a*.

Power is also supplied to three sensor means 13*a*, 13*b*, and 13*c* (see also FIG. 1), which are in the form of photoelectric cells or the like. The photocells are of conventional construction (not shown), and include an internal light source which projects a beam of light from the unit and a photocell which detects the reflection of the light beam off a nearby object.

Photocell 13*a* comprises a single photocell unit, hereafter designated PC1, which is located intermediate the two drive rollers 3 and 6 (see FIGS. 1, 8 and 11) and which is thereby in position to detect the presence of the cant 30 upon the rollers 3 and 6. Photocell PC1 operates contact X6 (see line 2 of FIG. 6) such that, when photocell PC1 is uncovered (i.e. the beam of light is not being reflected off a nearby object), contact X6 is open, and, conversely, when PC1 is covered (i.e. the light beam is being reflected off a nearby object), contact X6 is closed.

Photocell 13*b* also comprises a single photocell unit, hereafter designated PC4, which is located substantially perpendicularly above the drive rollers 3 and 6 (see FIG. 1) so that, as the tail end 31 is blown off the cant 30 and travels toward the delivery table 12, photocell PC4 is sequentially covered and uncovered. Photocell PC4 operates contact X4 (see line 4 of FIG. 6) such that, when photocell PC4 is uncovered, contact X4 is open, and, conversely, when photocell PC4 is covered, contact X4 is closed.

In the embodiment shown in FIG. 1, photocell 13*c* comprises a single photocell unit, hereafter designated PC5, which is located slightly beneath the surface of the delivery table 12 (see also FIG. 8) and is thereby in position to detect the presence of the tail end 31 upon the delivery table 12. Photocell PC5 operates contact PC5 (see line 5 of FIG. 6). Unlike the normally open contacts X6 and X4 which are associated with, respectively, photocells PC1 and PC4, contact PC5 is normally located in a closed position. Contact PC5 is moved to the open position only when photocell PC5 is simultaneously placed in an activated condition and is covered by a nearby object.

The flow of power through the circuit shown in lines 1 through 10 of FIG. 6 can be traced by first assuming that the cant 30 has just arrived upon the drive rollers, as is shown in phantom lines in FIG. 1.

Photocell PC1 is thus covered and contact X6 closed. This permits relay YO to be energized through now closed contact X6 and the normally closed contacts R14 and R9*a*. When thus energized, relay YO closes contact YO. Solenoid 46 is also actuated by virtue of the same closed circuit.

As heretofore described and as is seen in FIG. 10, the actuation of solenoid 46 moves the valve 44 from its normally closed position to its open position to permit pressurized air to flow to the blow nozzles 14. The loose tail end 31 is consequently blown off the cant 30 shortly after the arrival of the cant 30 upon the rollers 3 and 6.

During the passage of the tail end 31 toward the delivery table 12, it will momentarily cover photocell PC4. Contact X4 is thus closed, and relay YP is energized through normally closed contact R9*a* and now closed contacts YO and X4. When relay YP is thus energized, contact YP is closed, which activates photocell PC5. By this time, the tail end 31 will have settled upon the delivery table 12.

Since photocell PC5 is now in an activated condition and is covered by the tail end 31, normally closed contact PC5 is moved open. The drive rollers 3 and 6 continue to rotate the cant 30 in the "rewinding" direction, and the tail end 31 is drawn across the delivery table 12 toward the cant 30. Eventually, the advancing tail end 31 will uncover photocell PC5, at which time contact PC5 returns to its normally closed position. Relay CR3 is thus energized through closed contacts YP and PC5.

When relay CR3 is thus energized, normally closed contact R3*a* is caused to open and normally open contact R3*b* is caused to close. Power to the motor 4 is interrupted by the opening of contact R3*a* (line 7 of FIG. 6), and rotation of the cant 30 by the drive rollers 3 and 6 ceases.

By virtue of the above described control circuit, and in particular, the circuit interconnecting photocell PC4 and PC5, any unintended interference with photocell PC5 by nearby objects prior to the arrival of the tail end 31 upon the delivery table 12 will not operate contact PC5, and thus ultimately terminate cant rotation, since photocell PC5 is normally in a deactivated condition and is placed in an activated condition in time to sense only the presence of the loose tail end 31 on the delivery table 12. Thus, the chance of unintentional or inadvertent operation of photocell PC5, and thus undesired cessation of cant rotation, is eliminated.

However, it is possible that arrival of the tail end 31 from the cant 30 to the delivery table 12 may be delayed, in which case the activation of photocell PC5 by relay YP can precede the arrival of the loose tail end 31 on the delivery table 12. When this occurs, the as yet normally closed contact PC5 and in series with closed contact YP, will energize relay CR3 and prematurely terminate power to the roller drive motor 4. As a result, cant rotation will be terminated, notwithstanding the fact that the loose tail end 31 is not in the desired position on the delivery table 12.

In order that photocell PC5 is not activated before the tail end 31 settles upon the delivery table 12, timer unit TD5 (shown in phantom lines in line 4 of FIG. 6) is placed in series with photocell PC4, such that relay YP is energized a predetermined time period after the passage of the tail end 31 past photocell PC4. The time relay thus interjected assures that photocell PC5 is not activated prior to the arrival of the tail end 31 upon the delivery table 12.

Figure 7:
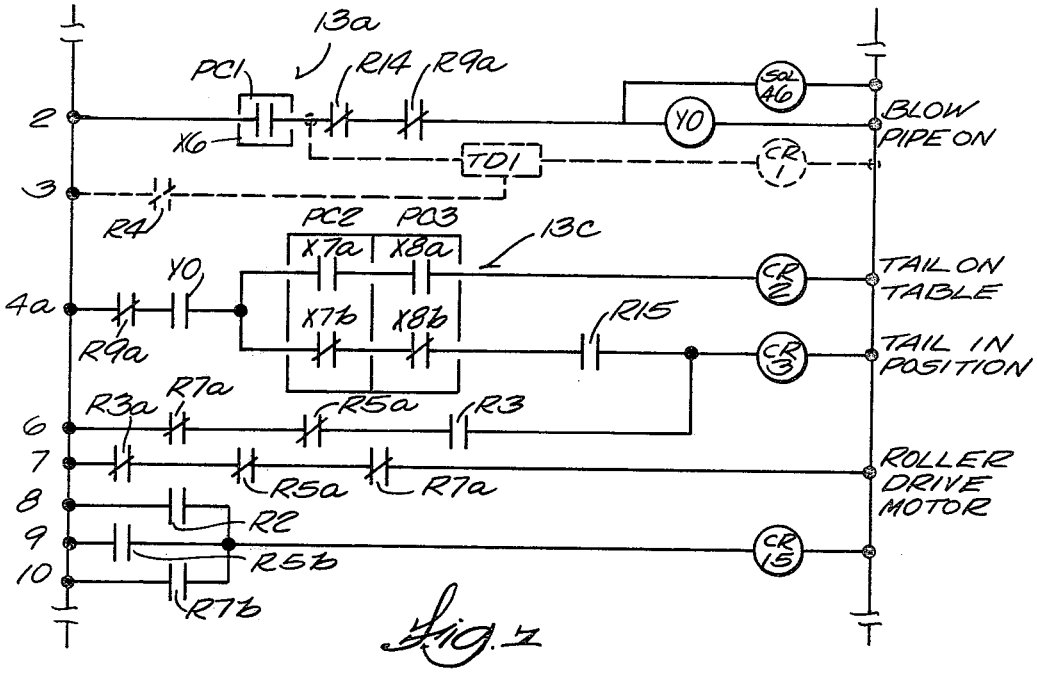
FIG. 7 is an alternative embodiment of the electrical control circuit involved in the Tail Positioning Stage of the machine shown in FIG. 1.

FIG. 7 illustrates an alternate embodiment of the control circuit associated with the Tail Positioning Stage, and components which are common with the just described embodiment are assigned the same reference numerals.

In this embodiment, like the first described embodiment, photocell 13*a* comprises the single photocell unit PC1 which is located between the drive rollers 3 and 6. However, unlike the first described embodiment, photocell 13*b* is eliminated, and photocell 13*c* comprises two photocells PC2 and PC3 which are located slightly beneath the surface of the delivery table 12 at opposite ends of the delivery table 12 (see FIG. 11) and are thereby in position to jointly detect the presence of the outer edges 31*a* and 31*b* of the tail end 31 upon the delivery table 12.

Each photocell PC2 and PC3 operates a pair of contacts (see line 4*a* of FIG. 7), which are, respectively, X7*a* and X7*b* for PC2 and X8*a* and X8*b* for PC3. When PC2 or PC3 is uncovered, the respective contacts X7*a* or X8*b* are open and the respective contacts X7*b* or X8*b* are closed. When PC2 or PC3 are covered, the contacts reverse themselves, and contacts X7*a* and X8*b* close and contacts X7*b* and X8*b* open.

The flow of power through the alternative circuit embodiment can be traced by assuming that the tail end 31 has been blown off the cant 30 and has settled upon the delivery table 12. Photocells PC2 and PC3 will be thus covered (see FIG. 11) and contacts X7*a* and X8*a* are thereby caused to close, and contacts X7*b* and X8*b* are thereby caused to open. Relay CR2 is thus energized through now closed contacts X7*a*, X8*a*, and YO and through normally closed contact R9*a* (line 4*a* of FIG. 7). When relay CR2 is thus energized, contact R2 is closed, which permits relay CR15 to be energized (line 8 of FIG. 7). By virtue of energizing relay CR15, contact R15 is closed.

Meanwhile, the drive rollers 3 and 6 continue to impart rotation to the cant 30 in the "rewinding" direction, and the tail end 31 is drawn across the delivery table 12 toward the cant 30. Eventually, the advancing tail end 31 will uncover photocells PC2 and PC3, and the associated contacts X7*a*, X7*b* and X8*b*, and X8*b* will reverse their previous dispositions, contacts X7*a*, and X8*a* now being caused to open and contacts X7*b* and X8*b* now being caused to close.

This permits relay CR3 to be energized through now closed contacts X7*b*, X8*b*, YO, and R15 and through normally closed contact R9*a* (line 4*a* of FIG. 7). As before described, by the activation of relay CR3, normally closed contact R3*a* is caused to open and normally open contact R3*b* is caused to close, and power to the motor 4 is interrupted (line 7 of FIG. 7).

As should now be apparent, photocells PC2 and PC3 are connected such that contacts X7*a* and X8*a* and contacts X7*b* and X8*b* are in series relationship with each other. By virtue of this arrangement, it is necessary that PC2 and PC3 be simultaneously covered, then uncovered, by the adjacent outer tail edge 31*a* and 31*b* in order to complete the electrical sequence of the circuit just described and shown in line 4*a* of FIG. 7. Should the outer edges 31*a* and 31*b* of the tail end 31 be torn or otherwise uneven (as shown in phantom lines in FIG. 11), and as a result none or only one of the photocells PC2 and PC3 is covered, the control circuit which ultimately terminates cant rotation will not be activated. Thus, photocells PC2 and PC3 are operative to sense a cant 30 having a defective tail end 31 which is not in condition to be glued.

It should be apparent that, by virtue of the two alternate embodiments of the circuit shown in FIGS. 6 and 7, the loose tail end 31 will always be located in a predetermined position upon the delivery table 12 when cant rotation is terminated. This insures that the glue seam will invariably be applied at the same predetermined distance from the edge of the tail end 31.

B. The Tail Gluing Stage

Figure 9:
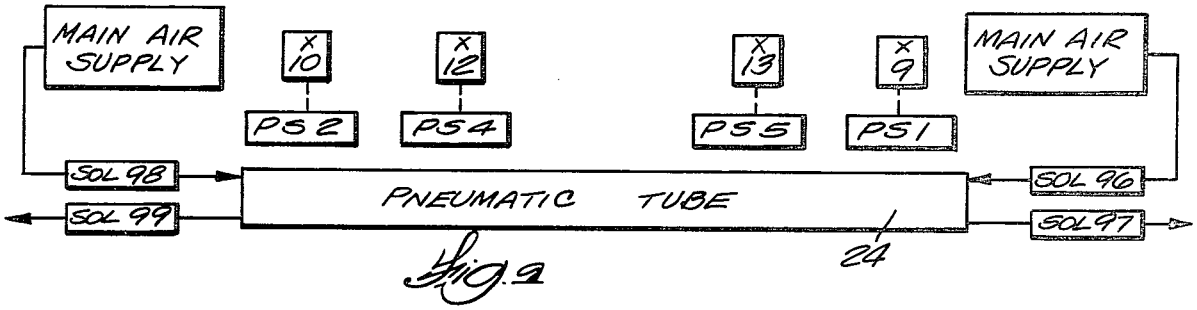
FIG. 9 is a schematic view of the components of the pneumatic control circuit involved in powering the glue gun carriage shown alternatively in FIGS. 1 and 2 and FIGS. 3 and 4.

Reference is now made to lines 11 through 18 of FIG. 6, which illustrate the control circuit involved in applying glue upon the tail end 31, and also to FIGS. 9 and 10, which illustrate the associated pneumatic control mechanism responsible for propelling the glue gun carriage chassis 17 back and forth along the beams 22 and 23 (the embodiment shown in FIGS. 1 and 2) or beams 62 and 63 (the embodiment shown in FIGS. 3 and 4).

Simultaneously with the activation of relay CR3 in the first circuit embodiment (line 5 of FIG. 6), relay CR2 is energized. In the second embodiment (line 4*a* of FIG. 7), relay CR2 is energized when the tail end 31 arrives upon the delivery table 12 and covers photocells PC2 and PC3. In both embodiments, the energization of relay CR2 closes contact R2 which energizes relay CR15 (see line 8 of FIGS. 6 and 7. When relay CR15 is energized, contact R15 is closed.

The closing of contact R15 energizes solenoid 52 (line 11 of FIG. 6). As heretofore described and as is seen in FIG. 10, the actuation of solenoid 52 moves the valve 50 from its normally closed position to its open position to permit pressurized air to flow to the glue gun 14 to pneumatically expel glue therefrom.

Simultaneously, the carriage chassis 17 is pneumatically propelled over the delivery table 12, so that glue being pneumatically expelled from the gun 14 is applied along the longitudinal length of the stationary tail end 31.

More particularly, and referring first to FIG. 10, the air inlet valve 54 is operatively movable between three positions. The first, or center, position blocks the flow of pressurized air to both ends of the hose 24, hereafter referred to, respectively, as the left and right ends. The second, or right, position directs pressurized air through a right supply conduit 78, unseating a normally closed check valve 80 communicating therewith, to enter the right end of the hose 24. In like fashion, the third, or left, position directs pressurized air through a left supply conduit 82, unseating another normally closed check valve 84, to enter the left end of the hose 24.

The venting valve means 58 includes outlet valve means for independently venting the right and left ends of the hose with the atmosphere. While various constructions are possible, in the illustrated embodiment (FIG. 10), the right end and left end of the hose are independently vented to the atmosphere through separate outlet conduits, respectively, 86 and 88, each having its own outlet valve, respectively, 87 and 89. Each outlet valve 87 and 89 is operatively movable between a normally fully vented position, in which the respective end of the hose 24 freely communicates with the atmosphere (shown in FIG. 10), and a partially vented position, in which the respective end of the hose 24 is vented to the atmosphere through a restricted orifice 90 or the like.

A normally closed check valve, respectively, 91 and 92 is interposed between each end of the hose 24 and its associated outlet valve 87 and 89 so that neither the left nor the right ends of the hose are normally vented to the atmosphere. Each check valve 91 and 92 is unseated to vent the respective end with the atmosphere in response to the passage of air through a secondary outlet conduit, respectively, 93 and 94. Air flows through the respective conduit 93 and 94 as air confined in the adjacent hose end is expelled in response to the approach of the carriage chassis 17 toward that end.

In context of the particular arrangement of components just described, acceleration solenoids 96 and 98 are operatively connected with the inlet valve 54 and with the electrical control circuit (see lines 15 and 16 of FIG. 6) for imparting accelerated movement to the carriage chassis 17, respectively, toward the left and toward the right. Correspondingly, deceleration solenoids 97 and 99 are operatively connected, respectively, with the right outlet valve 87 and the left outlet valve 89 and with the electrical control circuit (see lines 17 and 18 of FIG. 6) for selectively controlling the venting of the respective hose end with the atmosphere to impede the accelerated movement of the carriage chassis 17 imparted by either acceleration solenoid 96 or 98.

More particularly, and referring first to FIG. 9, four conventional proximity switches, hereafter referred to as PS1, PS2, PS4 and PS5, are generally spaced adjacent to the hose 24 along the travel path of the carriage chassis 17. Proximity switches PS1 and PS2 are located, respectively, at the far right and far left ends of the hose 24. Proximity switch PS4 is located adjacent to PS2 on the left end of the hose 24, and proximity switch PS5 is located adjacent to PS1 on the right end of the hose 24. The proximity switches PS1, PS2, PS4 and PS5 are each connected to an associated electrical contact which is interposed in the electrical control circuit, respectively, X9, X10, X12 and X13 (see also lines 12 through 18 of FIG. 6). The contacts X9, X10, X12 and X13 are disposed in normally open positions, and the location of the carriage chassis 17 adjacent to the associated proximity switch will cause the respective contact to close.

The flow of power through the control circuit shown in lines 11 through 18 of FIG. 6 can now be traced by first assuming that the carriage chassis 17 is located at the far right end of the hose 24 and, thus, adjacent to proximity switch PS1. Contact X9 is thereby closed, and this permits relay CR5 to be energized (see line 13 of FIG. 6) through now closed contact X9, closed contact R3*b* (which is closed because relay CR3 was energized during the Tail Positioning Stage), and normally closed contact R9*a*. When relay CR5 is thus energized, normally closed contact R5*a* is caused to open and normally open associated contact R5*b* is caused to close.

When contact R5*a* opens, relay CR3 is deenergized (see line 6 of FIG. 6), thereby returning contact R3*a* to its normally closed position and contact R3*b* to its normally open position. However, power remains interrupted to the roller drive motor 4 (line 7 of FIG. 6), notwithstanding the closing of contact R3*a*, because contact R5*a* is now disposed in the open position.

When contact R5*b* closes, acceleration solenoid 96 is energized through now closed contact R5*b* and normally closed contact R10 (line 15 of FIG. 6). The inlet valve 54 is consequently moved from its center position to its right position, and pressurized air is directed to the right end of the hose 24 through conduit 78 and unseated check valve 80. Inasmuch as the carriage chassis 17 is located at the right end of the hose 24, accelerated movement of the carriage chassis 17 from the right end toward the left end will result as pressurized air occupies and expands the right end of the hose 24.

It should be noted that, by virtue of closed contact R5*b*, relay CR15 remains energized (see line 9 of FIG. 6), thus assuring contact R15 remains closed to energize solenoid 52 to expel glue from the glue gun 15 during the travel of the carriage chassis 17.

As the carriage chassis 17 accelerates toward the left hand side of the hose 24, it will eventually actuate proximity switch PS4 (see FIG. 9), thus closing contact X12. As seen in line 17 of FIG. 6, this permits deceleration solenoid 99 to be enrgized through now closed contact X12 and normally closed contact R7*a*. This also permits relay CR10 to be energized, which causes normally closed contact R10 to open.

The actuation of deceleration solenoid 99 shifts the left outlet valve 89 from its normally fully vented position to its partially vented position. The expulsion of air into the atmosphere through conduit 94, unseated left check valve 92, and the left outlet valve 89, heretofore unrestricted, is suddenly restricted by orifice 90, and backpressure, or a pneumatic "cushion", is subsequently created in the left end of the hose 24.

At the same time that the "cushion" is being created by operation of the deceleration solenoid 99, the opening of normally closed contact R10 interrupts the flow of power to acceleration solenoid 96 (see line 15 of FIG. 6), and the inlet valve 54 consequently returns from its right position back to its normally centered position. The flow of pressurized air to the right end of the hose 24 is terminated.

Thus, just as backpressure is building to impede acceleration of the carriage chassis 17 toward the left hand side of the hose 24, the flow of pressurized air to the right hand side of the hose 24, which occasioned the accelerated movement in the first place, is terminated. The carriage chassis 17 rapidly decelerates. A conventional shock absorber (not shown) may be located at the left end of the hose 24 to cushion whatever impact may occur.

The carriage chassis 17, now located at the left hand side of the hose 24, actuates proximity switch PS2 (see FIG. 9), thereby closing contact X10. This deactuates relay CR5 (see line 12 of FIG. 6), which causes contact R5*a* to close and contact R5*b* to open. Relay CR15, in turn, is deenergized (line 9 of FIG. 6), opening contact R15 to deactuate solenoid 52 to prevent further expulsion of glue from the gun 15.

Since the actuation of relay CR5 will immediately lead to the deactuation of relay CR3 (line 6 of FIG. 6), and thus the opening of contact R3*b*, the electrical sequence shown in line 13 of FIG. 6, in which the position of the carriage chassis 17 at one end of the hose 24 is first sensed and the carriage chassis 17 then accelerated toward the opposite end, will occur only once during the Tail Gluing Stage. Thus, the carriage chassis 17 makes only a single pass over the loose tail end 31 during each Tail Gluing Stage.

The travel of the carriage chassis 17 from the left hand side to the right hand side of the hose 24 follows the same electrical sequence as just described, although different relays are involved. Generally, when the carriage chassis 17 is located at the left hand side of the hose 24, proximity switch PS2 is actuated, closing contact X10 and permitting relay CR7 to be energized (see line 13 of FIG. 6). When relay CR7 is thus energized, normally closed contact R7*a* is opened and normally open contact R7*b* is closed. The closing of contact R7*b* actuates acceleration solenoid 98 (see line 16 of FIG. 6), moving the inlet valve 54 from its center position to its left position (see FIG. 10), and pressurized air thus enters the left end of the hose to propel the carriage chassis 17 toward the right.

As the carriage accelerates toward the right, proximity switch PS5 will be actuated (see FIG. 9), closing contact X13 and permitting deceleration solenoid 97 and relay CR11 to be energized (see line 18 of FIG. 6). The right outlet valve 87 is thereby shifted to its partially vented position simultaneously with the interruption of power to acceleration solenoid 98. Thus, the carriage chassis 17 is rapidly decelerated, and a shock absorber (not shown) may be located at the right hand side of the hose to cushion whatever impact may occur.

By virtue of the above described circuit, a line of glue has been quickly applied to the tail end shortly after the positioning of the tail end 31 upon the delivery table 12.

C. Tail Rewinding and Cant Ejection Stage

Reference is now made to lines 19 through 26 of FIG. 6, which illustrate the control circuit involved in first rewinding the glued tail end 31 upon the cant 30 which is then followed by the ejection of the cant 30 from the rollers 3 and 6.

The energization of either relay CR5 or CR7 at the beginning of the Tail Gluing Stage (line 13 of FIG. 6), thereby closing associated contact R5*b* or R7*b* as heretofore described, causes relay CR9 to become energized (lines 20 and 21 of FIG. 6). When relay CR9 is thus energized, normally closed contact R9*a* is caused to open and normally open contact R9*b* is caused to close.

The opening of contact R9*a* deactuates solenoid 46 (line 2 of FIG. 6), and the valve 44 is returned to its normally closed position to block the flow of pressurized air to the blow nozzles 14. At this operational stage, the tail end 31 has already been lifted off the cant 30 and is located on the delivery table 12, and it should be apparent that further operation of the blow nozzles 14 is not necessary.

The closing of contact R9*b* energizes timer TD2 (line 23 of FIG. 6). Timer TD2 interposes a time delay of predetermined length and thereafter actuates solenoid 76 as well as relay CR4.

During the time delay interposed by timer TD2, and thus prior to actuation of solenoid 76 and relay CR4, the glue gun carriage chassis 17 is being sequentially accelerated and stopped at its destination at the left or right end of the hose 24 under the influence of the pneumatic control circuit as heretofore described. As has also been heretofore described, either acceleration relay CR5 or acceleration relay CR7 become deenergized upon the arrival of the carriage 17 at its respective destination at the end of the Tail Gluing Stage, closing either associated contact R5*a* or R7*a*. Inasmuch as contacts R3*a*, R5*a*, and R7*a* are now all commonly disposed in their normally closed positions, power is restored to the roller drive motor 4 (see line 7 of FIG. 6), and rewinding of the glued tail end 31 upon the cant 30 commences.

The length of the time delay interposed by timer TD2 is calculated to encompass not only this carriage travel time, and it thereafter encompasses an additional period of time to permit the now activated rollers 3 and 6 to rewind the tail end 31 upon the cant 30 before actuation of solenoid 76 occurs. Generally, a carriage travel time of less than one second is to be expected, therefore a timer TD2 delay of two seconds will permit a rewind time of over one second (the difference between the total time delay and the carriage travel time) which is usually sufficient.

Upon the end of the time delay period, solenoid 76 is energized, which opens air valve 74 to permit the flow of pressurized air to the setting cylinders 9. The cant 30 is caused to be ejected from the drive rollers 3 and 6.

An additional proximity switch PS3 (see FIG. 8) is located on the frame 1 in the path of movement of the second roller 6 occasioned by operation of the setting cylinders 9. In particular, the proximity switch PS3 is located to detect the position of the second roller 6 at its uppermost pivotal position during the Cant Ejection Stage. Proximity switch PS3 is electrically connected to normally closed contact X14 (see lines 22 and 24 of FIG. 6) such that the location of the second roller 6 adjacent to proximity switch PS3 causes normally closed contact X14 to open.

The opening of contact X14 resets timer TD2 (line 24 of FIG. 6). At the same time the opening of contact X14 deenergizes relay CR9 (see line 22 of FIG. 6), thereby causing contact R9*a* to close and contact R9*b* to open. Solenoid 76 is deactuated by the opening of contact R9*b* (line 23 of FIG. 6), and the valve 74 is thereby returned to its normally closed position to block the conduction of pressurized air to the setting cylinders 9. The second roller 6 thus returns to its normal side-by-side position with the first roller 3.

As can be seen in FIG. 1, the pivoting of the second roller 6 relative to the first roller 3 will cause the second roller 6 to momentarily pass in front of photocell 13*a*. This will close contact X6 (line 2 of FIG. 6) to actuate the blow nozzle solenoid 46 before it is operationally desirable to do so. To prevent the premature actuation of the blow nozzle solenoid 46, a third timer unit TD3 is provided (line 25 of FIG. 6). More particularly, simultaneously with actuating solenoid 76 to eject the cant from the rollers, timer TD2 actuates relay CR4 which opens normally closed contact R4 and actuates timer TD3.

When timer TD3 is thus actuated, relay CR14 is energized for a predetermined period of time. During the time in which relay CR14 is energized, normally closed contact R14 is caused to open. When contact R14 is opened (line 2 of FIG. 6), power to the blow nozzle solenoid 46 is interrupted, notwithstanding the closing of photocell contact X6 as the second roller 6 passed in front of photocell 13*a*.

The length of time interjected by timer TD3 is predetermined so as to correspond with the time it takes the second roller 6 to move from its side-by-side position with the first roller 3 to its uppermost pivotal position adjacent proximity switch PS3 and return. After this period of time, timer TD3 becomes deactuated and relay CR14 is deenergized, returning contact R14 to its normally closed position, after which the closing of photocell contact X6 occasioned by the arrival of a new cant 30 upon the rollers 3 and 6 will again actuate blow nozzle solenoid 46.

D. Secondary Cant Ejection Control

Figure 11:
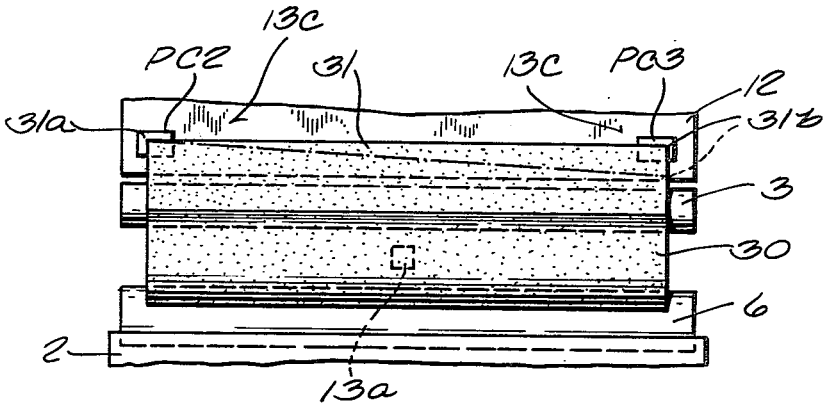
FIG. 11 is a fragmentary top view of the machine shown in FIGS. 1 and 8.

Typically, cants are delivered to the drive rollers 3 and 6 in assembly-line fashion at closely spaced intervals, such as by a conveyor belt or the like (not shown). To insure that one cant has been ejected from the device prior to the arrival of a subsequent cant, a secondary ejection control circuit is provided which will eject the cant after it spends a predetermined period of time on the drive rollers 3 and 6, regardless of whether or not the three operational sequences just described have been completed. For example, should the tail end 31 be stuck to the body of the cant 30, actuation of the control circuit shown in lines 1 through 10 of FIG. 6 will not take place, inasmuch as photocells PC4 and PC5 will not be covered by the stuck tail end 31. Further, should the tail end 31 be stuck or uneven (as shown in FIG. 11), actuation of the alternate control circuit (shown in FIG. 7) will not take place, inasmuch as photocells PC2 and PC3 will not be concurrently operated by the stuck or uneven tail end 31. Thus, the secondary ejection control circuit is necessary to eject this defective cant prior to arrival of the subsequent cant and thereby avoid cant collision and mechanical jamming.

More particularly, and referring first to line 2 of FIGS. 6 and 7, the closing of contact X6 occasioned by the detection by photocell PC1 of the cant on the drive rollers 3 and 6 actuates timer TD1 (shown in phantom lines in FIGS. 6 and 7). After a predetermined time delay, timer TD1 energizes relay CR1, and associated contact R1 is closed. This permits relay CR9 to become energized to initiate the cant ejection sequence (line 19 of FIG. 6). The eventual energization of relay CR4 during the cant ejection cycle opens contact R4 and resets timer TD1 (line 3 of FIGS. 6 and 7).

Thus, in either circuit embodiment, should relays CR5 or CR7 fail to become energized within a predetermined period of time to energize the cant ejection relay CR9 (lines 20 and 21 of FIG. 6), relay CR1 will become energized to do so.

It should now be apparent that the device 32 as above described provides for efficient, high speed finishing of the rolled product.

I claim:

1. A device for sticking the end of a roll of wound sheet-like material to the roll comprising means for rotating the roll about its longitudinal axis in the winding-up direction and blowing means for blowing the end of the sheet-like material off the roll, the blown-off end cooperating with a sensor for stopping the drive of the roll when said end has reached a position on a supporting member suitable for the application of glue, in which device two sensors are provided, the first sensor being disposed so that it detects a movement of the end of the sheet-like material in the direction toward the supporting member and then actuates the second sensor which is arranged adjacent the supporting member, the second sensor being arranged to stop the drive of the roll when the end of the strip of material uncovers the second sensor.

2. In a machine operative for handling a roll of wound sheet-like material having a loose tail end, the machine including means for rotating the roll in a direction tending to wind the loose tail end upon the roll, means for unwinding the loose tail end off the roll during rotation, and a delivery table upon which the loose tail end settles after being wound off the roll, the improvement which comprises:

first sensor means for detecting the unwinding of the loose tail end off the roll;

second sensor means operative between a normally deactivated condition and an activated condition for detecting the location of the tail end at a predetermined position on the delivery table;

first circuit means for placing said second sensor means in said activated condition in response to the detection by said first sensor means of the unwinding of the tail end off the roll; and second circuit means for terminating operation of the roll rotation means in response to the detection by said activated second sensor means of the location of the tail end at a predetermined position on the delivery table.

3. The improvement according to claim 2 wherein said first sensor means is located substantially perpendicularly above the roll rotation means.

4. The improvement according to claim 2 wherein said second sensor means includes photocell means mounted on the delivery table; and wherein said second circuit means includes means for operating the roll rotation means when said second sensor means is in said deactivated condition and also when said second sensor means is in said activated condition and said photocell means is covered by the loose tail end and for terminating the operation of the roll rotation means when said second sensor means is in said activated condition and said photocell means is uncovered by the loose tail end.

5. The improvement according to claim 2 wherein said first circuit means includes timer means for placing said second sensor means in said activated condition a predetermined time period after the detection by said first sensor means of the tail end.

6. In a machine operative for handling a roll of wound sheet-like material having a loose tail end, the loose tail end having oppositely spaced first and second corner edges, the machine including means for rotating the roll in a direction tending to wind the loose tail end upon the roll, means for unwinding the loose tail end off the roll during rotation, and a delivery table upon which the loose tail end settles after being unwound off the roll, the improvement which comprises:

first corner edge sensing means for detecting the location of the first corner edge of the tail end at the predetermined position on the delivery table;

second corner edge sensing means for detecting the location of the second corner edge of the tail end at a predetermined position on the delivery table;

circuit means interconnecting said first corner edge sensing means and said second corner edge sensing means with the roll rotation means and operative for terminating operation of the roll rotation means in response to the simultaneous detection by said first and second corner edge sensing means of the location of the respective first and second corner edges at their respective predetermined positions on the delivery table.

7. The improvement according to claim 6 wherein said first corner edge sensing means includes first photocell means mounted on the delivery table; and wherein said second corner edge sensing means includes second photocell means mounted on the delivery table in a spaced relationship relative to said first photocell means.

8. In a machine operative for handling a roll of wound sheet-like material having a loose tail end, the machine including means for rotating the roll in a direction tending to wind the loose tail end upon the roll, means for unwinding the loose tail end off the roll during rotation, a delivery table upon which the loose tail end settles after being unwound, gluing means for applying glue to the loose tail end situated on the delivery table, and means for ejecting the roll off the roll rotation means, the improvement which comprises:

roll sensor means for detecting the presence of the roll on the roll rotation means;

primary ejection circuit means for operating the roll ejection means subsequent to the operation of said gluing means; and secondary ejection circuit means for operating the roll ejection means independently of said primary ejection circuit means at a predetermined time after the detection by said roller sensor means of the presence of the roll on the roll rotation means.

9. The improvement according to claim 8 wherein the means for rotating the roll includes a drive motor, a first drive roller, a second drive roller adjacently spaced from and parallel to said first drive roller, means for operatively connecting said first and said second drive rollers with said drive motor for common rotation; and wherein said roll sensor means includes photocell means mounted intermediate said first drive roller and said second drive roller for sensing the location of the roll on said first and second drive rollers.

10. A fluid propulsion device comprising a support frame;

tube means mounted on said support frame and having opposite ends, said tube means operative for conducting a pressurized fluid;

supply conduit means for conducting a pressurized fluid from a source to each of said opposite ends;

vent means selectively operative for venting each of said opposite ends with the atmosphere;

carriage means mounted on said support frame and operatively connected with said tube means for movement between said opposite ends in response to the conduction of pressurized fluid by said tube means;

acceleration control means communicating with said supply conduit means and said vent means for conducting pressurized fluid through said supply conduit means to a selected one of said opposite ends and for simultaneously venting through said vent means the end opposite to said selected end, whereby accelerated movement is imparted to said carriage means from said selected end toward said opposite end; and deceleration control means communicating with said vent means for selectively restricting the venting of said opposite end, whereby movement of said carriage means toward said opposite end is decelerated.

11. A fluid propulsion device according to claim 10 wherein said opposite ends include a first opposite end and a second opposite end;

wherein said supply conduit means includes inlet valve means connected to said supply conduit means and operatively movable between a first inlet position for blocking the flow of pressurized fluid to said first and second ends, a second inlet position for conducting pressurized fluid to said first end and a third inlet position for conducting pressurized fluid to said second end;

wherein said vent means includes venting valve means connected to said vent means and operatively movable between a first venting position for blocking the venting of said first and second ends with the atmosphere, a second venting position for venting said second end with the atmosphere, and a third venting position for venting said first end with the atmosphere; and wherein said acceleration control means includes means for normally disposing said venting valve means in said first venting position when said inlet valve means is in said first inlet position, for disposing said venting valve means in said venting position when said inlet valve means is in said second inlet position, and for disposing said venting valve means in said third venting position when said inlet valve means is in said third inlet position.

12.

A fluid propulsion device according to claim 11 wherein said venting valve means includes a first check valve communicating with said first end and movable between a closed position blocking venting of said first end with the atmosphere and an open position for venting said first end with the atmosphere, and a second check valve communicating with said second end and movable between a closed position blocking venting of said second end with the atmosphere and an open position for venting said second end with the atmosphere; and wherein said means for disposing said venting valve means includes means for yieldably biasing said first and second check valves in said closed position, corresponding to said first venting position, means for moving said second check valve from said closed to said open position against the action of said biasing means in response to the expulsion of air from said second end, corresponding to said second venting position, and means for moving said first check valve from said closed to said open position against the action of said biasing means in response to the expulsion of air from said first end, corresponding to said third venting position.

13. A fluid propulsion device according to claim 11 wherein said acceleration control means includes first sensing means for moving said inlet valve means from said first inlet position to said second inlet position when said carriage means is located at said first end, and second sensing means for moving said inlet valve means from said first inlet position to said third inlet position when said carriage means is located at said second end.

14. A fluid propulsion device according to claim 13 wherein said first sensing means includes first proximity switch means mounted adjacent to said first end and operative for movement between an open position when said carriage means is located away from said first proximity switch means and a closed position when said carriage means is located adjacent to said first proximity switch means, and first acceleration solenoid means operatively connected with said inlet valve means and said first proximity switch means for moving said inlet valve means between said first inlet position to said second inlet position in response to movement of said first proximity switch means between said open position and said closed position; and wherein said second sensing means includes second proximity switch means mounted adjacent to said second end and operative for movement between an open position when said carriage means is located away from said second proximity switch means and a closed position when said carriage means is located adjacent to said second proximity switch means, and second acceleration solenoid means operatively connected with said inlet valve means and said second proximity switch means for moving said inlet valve means between said first inlet position and said third inlet position in response to movement of said second proximity switch means between said open position and said closed position.

15. A fluid propulsion device according to claim 11 wherein said acceleration control means includes means for moving said inlet valve means from said second inlet position to said first inlet position and from said third inlet position to said first inlet position in response to operation of said deceleration control means.

16. A fluid propulsion device according to claim 11 wherein said venting valve means includes first outlet valve means connected to said venting valve means adjacent said first end and operatively movable between a fully vented position for freely venting said first end with the atmosphere when said venting valve means is in said third venting position and a partially vented position for partially venting said first end with the atmosphere when said venting valve means is in said third venting position, and second outlet valve means connected to said venting valve means adjacent said second end and operatively movable between a fully vented position for freely venting said second end with the atmosphere when said venting valve means is in said second venting position and a partially vented position for partially venting said second end with the atmosphere when said venting valve means is in said second venting position.

17. A fluid propulsion device according to claim 16 wherein said tube means includes a center portion intermediate said first and second ends, a first portion located intermediate said first end and said center portion, and a second portion located intermediate said second end and said center portion; and wherein said deceleration control means includes third sensing means for moving said first outlet valve means from said fully vented position to said partially vented position when said carriage means is located in said first portion, and fourth sensing means for moving said second outlet valve means from said fully vented position to said partially vented position when said carriage means is located in said second portion.

18. A fluid propulsion device according to claim 17 wherein said third sensing means includes third proximity switch means mounted adjacent to said first portion and operative for movement between an open position when said carriage means is located away from said third proximity switch means and a closed position when said carriage means is located adjacent to said third proximity switch means, first deceleration solenoid means operatively connected with said first outlet valve means and said third proximity switch means for moving said first outlet valve means between said fully vented position and said partially vented position in response to movement of said third proximity switch means between said open position and said closed position, whereby movement of said first outlet valve means from said fully vented position to said partially vented position creates a backpressure of air in said first end which resists movement of said carriage means toward said first end; and wherein said fourth sensing means includes fourth proximity switch means mounted adjacent to said second portion and operative for movement between an open position when said carriage means is located away from said fourth proximity switch means and a closed position when said carriage means is located adjacent to said fourth proximity switch means, second deceleration solenoid means operatively connected with said second outlet valve means and said fourth proximity switch means for moving said second outlet valve means between said fully vented position and said partially vented position in response to movement of said fourth proximity switch means between said open position and said closed position, and whereby movement of said second outlet valve means from said fully vented position to said partially vented position creates a backpressure of air in said second end which resists movement of said carriage means toward said second end.

19. A fluid propulsion device according to claim 10 wherein said tube means includes a resilient hose.

20. A fluid propulsion device according to claim 19 wherein said carriage means includes roller means movably attached to said resilient hose and operative for pinching a portion of said resilient hose to block the conduction of pressurized fluid through said portion.

21. A fluid propulsion device according to claim 10 wherein said carriage means includes a spaced pair of beams attached to said frame, a carriage chassis having opposite sides, and wheel means mounted on each side of said carriage chassis for mounting said carriage chassis for movement on and intermediate of said beams.

22. A fluid propulsion device according to claim 21 wherein said wheel means includes a runner mounted on each side of said carriage chassis for rotation, the rotational axes of said runners being disposed at right angles relative to each other.

23. A fluid propulsion device according to claim 21 wherein said wheel means includes a pair of runners mounted on each side of said carriage chassis for rotation, the rotational axis of one of said pair of runners being disposed at a right angle relative to the rotational axis of the other one of said pair of runners.

24. A fluid propulsion device according to claim 20 wherein said roller means includes a pair of closely spaced rollers between which said resilient hose is pinched, each of said pair of rollers including an outwardly bowed perimeter;

wherein said tube means includes a core member located inside said resilient hose and having symmetrical inwardly bowed sidewalls conforming to the outwardly bowed perimeter of said rollers; and whereby said resilient hose is pinched intermediate said rollers and said sidewalls of said core member.

25. A fluid propulsion device according to claim 24 wherein said core member is constructed of a solid material.

26. A fluid propulsion device according to claim 24 wherein said core member is constructed of a resilient material.

27. In a machine operative for handling a roll of wound sheet-like material having a loose tail end, the machine including means for rotating the roll in a direction tending to wind the loose tail end upon the roll, means for unwinding the loose tail end off the roll during rotation, a delivery table upon which the loose tail end settles after being unwound, gluing means for applying glue to the loose tail end situated on the delivery table, and means for ejecting the roll off the roll rotation means, the improvement which comprises:

roll sensor means for detecting the presence of the roll on the roll rotation means;

first tail sensor means for detecting the unwinding of the loose tail end off the roll;

second tail sensor means operative between a normally deactivated condition and an activated condition for detecting the location of the tail end at a predetermined position on the delivery table;

first circuit means for placing said second tail sensor means in said activated condition in response to detection by said first tail sensor means of the unwinding of the tail end off the roll;

second circuit means for terminating operation of the roll rotation means in response to the detection by said activated second tail sensor means of the location of the tail end at the predetermined position on the delivery table;

third circuit means for operating said gluing means in response to the detection by said activated second tail sensor means of the location of the tail end at the predetermined position on the delivery table;

primary ejection circuit means for operating the roll ejection means subsequent to the operation of the gluing means; and secondary ejection circuit means for operating the roll ejection means independently of said primary ejection circuit means at a predetermined time after the detection by said roll sensor means of the presence of the roll on the roll rotation means.

28. The improvement according to claim 27 wherein said primary ejection circuit means includes ejection delay means for reactivating the roll rotation means and thus rewinding the tail end back upon the roll prior to the ejection of the roll by the roll ejection means.

29. In a machine operative for handling a roll of wound sheet-like material having a loose tail end, the machine including means for rotating the roll in a direction tending to wind the loose tail end upon the roll, means for unwinding the loose tail end off the roll during rotation, a delivery table upon which the loose tail end settles after being unwound, gluing means for applying glue to the loose tail end situated on the delivery table, and means for ejecting the roll off the roll rotation means, the improvement which comprises:

tube means mounted on the machine over the delivery table and having opposite ends, said primary conduit means operative for conducting a pressurized fluid;

supply conduit means for conducting a pressurized fluid from a source to each of said opposite ends;

vent means selectively operative for venting each of said opposite ends with the atmosphere;

carriage means upon which the gluing means is mounted, said carriage means being operatively connected with said tube means for movement over the delivery table and between said opposite ends in response to the conduction of pressurized fluid by said tube means;

acceleration control means communicating with said supply conduit means and said vent means for conducting pressurized fluid through said supply conduit means to a selected one of said opposite ends and for venting through said vent means the end opposite to said selected end, whereby accelerated movement is imparted to said carriage means and thus the gluing means from said selected end toward said opposite end; and decleration control means communicating with said vent means for selectively restricting the venting of said opposite end, whereby movement of said carriage means and thus the gluing means toward said opposite end is decelerated.

30. The improvement according to claim 29 and further including first sensor means for detecting the unwinding of the loose tail end off the roll;

second sensor means operative between a normally deactivated condition and an activated condition for detecting the location of the tail end at a predetermined position on the delivery table;

first circuit means for placing said second sensor means in said activated condition in response to detection by said first sensing means of the unwinding of the tail end off the roll; and second circuit means for terminating the operation of the roll rotation means in response to the detection by said activated second sensor means of the location of the tail end at the predetermined position on the delivery table.

31. The improvement according to claim 29 and further including first corner edge sensing means for detecting the location of a corner edge of the tail end at a predetermined position on the delivery table;

second corner edge sensing means for detecting the location of the opposite corner edge of the tail end at a predetermined position on the delivery table; and circuit means interconnecting said first corner edge sensing means and said second corner edge sensing means with the roll rotation means for terminating operation of the roll rotation means in response to the simultaneous detection by said first and second corner edge sensing means of the location of the respective adjacent corner edges of the tail end at their respective predetermined positions on the delivery table.

32. The improvement according to claim 30 or 31 and further including roll sensor means for detecting the presence of the roll on the roll rotation means;

primary ejection circuit means for operating the roll ejection means subsequent to the operation of the gluing means; and secondary ejection circuit means for operating the roll ejection means independently of said primary ejection circuit means at a predetermined time after the detection by said roll sensor means of the presence of the roll on the roll rotation means.

33. The improvement according to claim 32 wherein said primary ejection circuit means includes ejection delay means for recommencing the operation of the roll rotation means, and thus rewinding the tail end back upon the roll, prior to the ejection of the roll by the roll ejection means.

* * * * *

UNITED STATES PATENT AND TRADEMARK OFFICE

CERTIFICATE OF CORRECTION

PATENT NO. : 4,244,767

DATED : January 13, 1981

INVENTOR(S) : Cornelis H. W. Hoeboer

It is certified that error appears in the above—identified patent and that said Letters Patent is hereby corrected as shown below:

Column 7, Line 6, After "airtight" delete "37 pinch""and substitute therefor ---"pinch"---

Column 9, Line 37, Before "PC5" delete "and" and substitute therefor ---with---

Column 10, Line 19, After "or" and before "are" delete "X8b" and substitute therefor ---X8a"

Line 21, After "and" and before "close" delete "X8b" and substitute therefor ---X8a---

Line 41, After "and" and before "X8b" delete "X8b and" and substitute therefor ---X8a,---

Column 14, Line 53, After "carriage" and before "17" insert ---chassis---

Column 16, Line 57, Claim 2, After "being" delete "wound" and substitute therefor ---unwound---

Column 19, Line 7, Claim 11, After "said" and before "vent-" insert ---second---

Signed and Sealed this

*Second* Day of *June 1981*

[SEAL]

*Attest:*

RENE D. TEGTMEYER

*Attesting Officer*

*Acting Commissioner of Patents and Trademarks*